US007827622B2

(12) United States Patent
Claro

(10) Patent No.: US 7,827,622 B2
(45) Date of Patent: Nov. 9, 2010

(54) MAGNETIC DEVICE FOR SLIDABLE ADJUSTMENT

(76) Inventor: Felipe Claro, Av. Apoquindo 3721, Piso 13, Casilla 1867, Las Condes, Santiago de Chile (CL) 6760352

( * ) Notice: Subject to any disclaimer, the term of this patent is extended or adjusted under 35 U.S.C. 154(b) by 346 days.

(21) Appl. No.: 12/169,023

(22) Filed: Jul. 8, 2008

(65) Prior Publication Data

US 2008/0282517 A1 Nov. 20, 2008

Related U.S. Application Data

(63) Continuation-in-part of application No. PCT/US2007/000327, filed on Jan. 9, 2007.

(51) Int. Cl.
*A42B 1/24* (2006.01)

(52) U.S. Cl. ..... 2/209.13; 2/195.4; 24/303

(58) Field of Classification Search ..... 2/183, 2/195.4, 209.13, 338; 24/303
See application file for complete search history.

(56) References Cited

U.S. PATENT DOCUMENTS 4,399,595 A * 8/1983 Yoon et al. ..... 24/303
4,941,236 A * 7/1990 Sherman et al. ..... 24/303
6,170,131 B1 1/2001 Shin ..... 24/303
6,412,116 B1 * 7/2002 Clark ..... 2/129
7,203,971 B2 * 4/2007 Claro ..... 2/195.2
2009/0288241 A1 * 11/2009 Fullerton et al. ..... 2/421

* cited by examiner

*Primary Examiner*—Katherine Moran
(74) *Attorney, Agent, or Firm*—Sanchelima & Associates, P.A.

(57) ABSTRACT

A magnetic fastening device with discrete slidable adjustments, comprising first and second sheets, each having a plurality of magnetic section elements with first and second poles disposed in alternating groups defining predetermined abutting patterns. The magnetic section elements are abuttingly disposed in two groups. In one group, the elements' magnetic field is disposed in one direction perpendicular to the sheets. In the other group, the elements' field is disposed in the opposite direction. The groups repeat themselves in an alternating pattern. The movement of the first and second sheets is constrained to keep them in an abutting relationship with respect to each other over a predetermined path over the first and second sheets, thereby permitting the sheets to be slidably movable along a predetermined distance relative to each other in discrete steps that overcome the attraction and repulsion forces of the magnetic section elements upon the application of a pulling force of a predetermined magnitude.

11 Claims, 3 Drawing Sheets

MAGNETIC DEVICE FOR SLIDABLE ADJUSTMENT

OTHER RELATED APPLICATIONS

The present application is a continuation-in-part of PCT patent application serial No. PCT/US07/00327, filed on Jan. 9, 2007 for Magnetic Device of Slidable Adjustment, which is hereby incorporated by reference.

BACKGROUND OF THE INVENTION

1. Field of the Invention

The present invention relates to a magnetic device for slidable adjustment of the position of two abutting members.

2. Description of the Related Art

Several designs for devices for adjusting the relative relationship between two bands, sheets, or objects have been designed in the past. Many of these devices include buckles and other mechanical items to keep fixed the relative and/or effective length of the device. These devices are capable of adjustment many times. However, there are no magnetic adjustment devices as the one claimed herein. Here, the positioning of magnetic elements in two cooperating bands or sheets with their movement constrained provides a novel mechanism for adjusting the relative position between the two bands or sheets. The resulting device can be utilized in a great number of applications.

Applicant believes that the closest reference corresponds to U.S. Pat. No. 6,170,131 issued to Shin on Jan. 9, 2001 for Magnetic Buttons and Structures Thereof. The patented device makes reference to a "magnetic zipper". Col. 2, line 44; Col. 6, lines 34 and 35. However, it differs from the present invention because the magnets are arranged in groups lacking a pattern that will alternate between attraction and repulsion forces. Shin does not disclose constraining the movement of sheets or bands to cause discrete movements from stable to unstable configurations.

The present invention is applicable to a diversity of objects that have two pieces to be removably affixed to each other and their relative position adjusted, so that the adjustment is accomplished without separating the two pieces but rather by sliding them with respect to each other.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device that slidably adjusts the relative position of two abutting sheets or bands that include groups of polarity-aligned discrete magnetic elements arranged in corresponding patterns.

It is another object of this invention to provide a device that can be used in a great variety of applications that require adjustable fastening devices.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists of the details of construction and combination of parts as will be more fully understood from the following description, when read in conjunction with the accompanying drawings in which.

DETAILED DESCRIPTION OF THE PREFERRED EMBODIMENT

Figure 1:
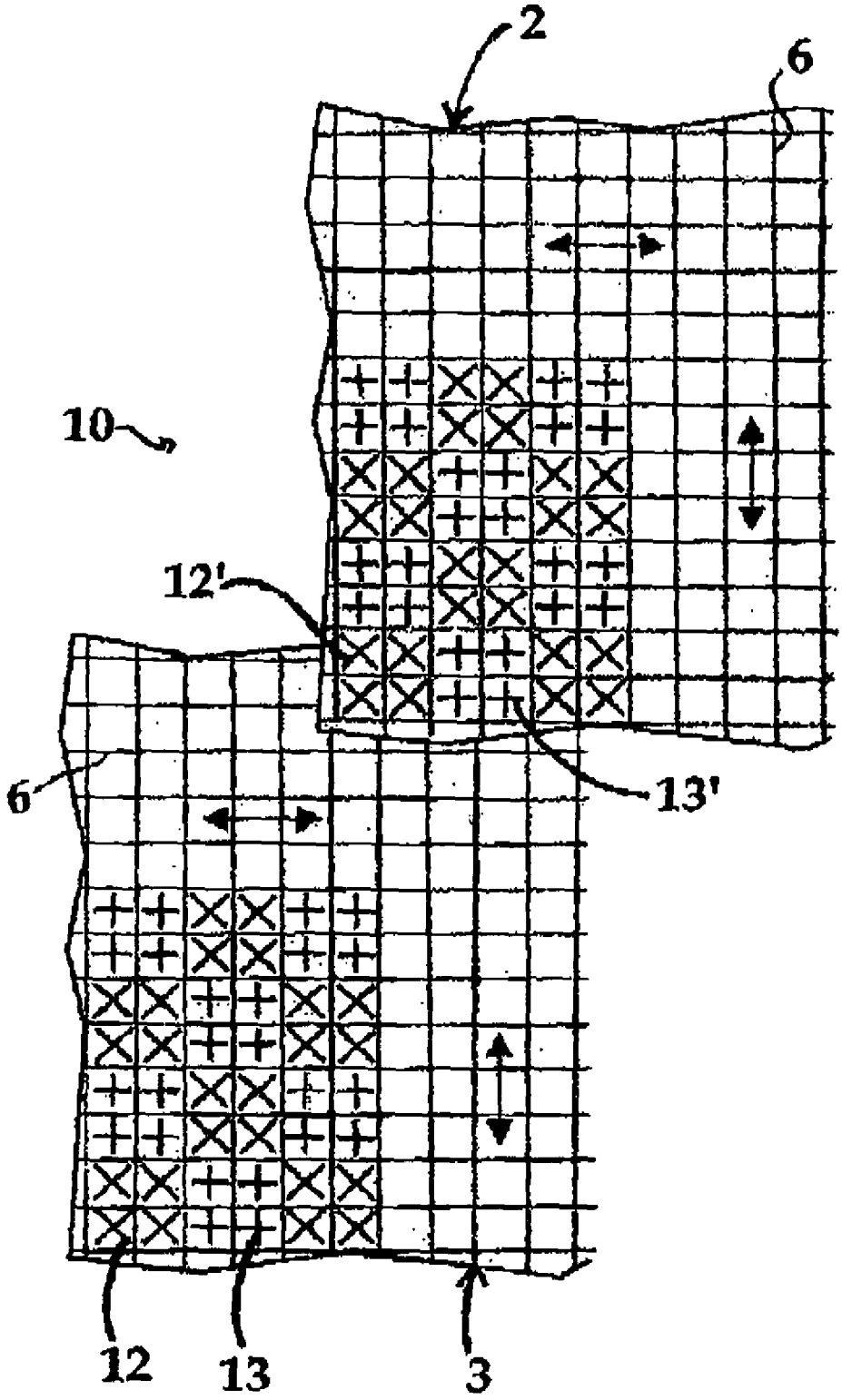
FIG. 1 is a top view representation of two cooperating bands or sheets that are about to be brought in abutting relationship with respect to each other. The patterns of groups of polarity-aligned discrete magnetic elements are shown.

Referring now to the drawings, where the present invention is generally referred to with numeral 10, it can be observed that it basically includes band or sheet assemblies 2 and 3, each including a complementing or similar patterns of groups 12 and 13 of discrete magnetic section elements 6. The pattern is such that when sheet assemblies 2 and 3 are brought in an abutting relationship with respect to each other, section elements 6 of groups 12 and 13 coincide so that abutting elements 6 are either the same pole (for repulsion) or opposite poles (for attraction). As best seen in FIG. 1, when the same poles coincide, sheets assemblies 2 and 3 will attempt to separate from each other or sidewise until a stable (attraction) relative position between sheet assemblies 2 and 3 is reached. Sheet assemblies 2 and 3 are forced to stay in an abutting relationship preventing their separation. The lateral movement of sheet assemblies 2 and 3 is also constrained so that their relative movement is allowed only along a predetermined longitudinal path. This can be accomplished by using a sheath or sleeve 40; 40', as shown in one of the applications below. As sheet assemblies 2 and 3 move with respect to each other, section elements 6 will exert either attraction or repulsion forces urging the relative positions of sheet assemblies 2 and 3 to stable positions where section elements 6 coincide with those having opposite poles.

In FIGS. 2 through 6, a preferred embodiment for the present invention is shown where the application is an adjustable cap. Typically, the adjustment for the head is adjusted in the back of a cap and, with the present invention, sleeves 40 and 40' cooperate to partially and slidably receive bands 42 and 43.

Figure 2:
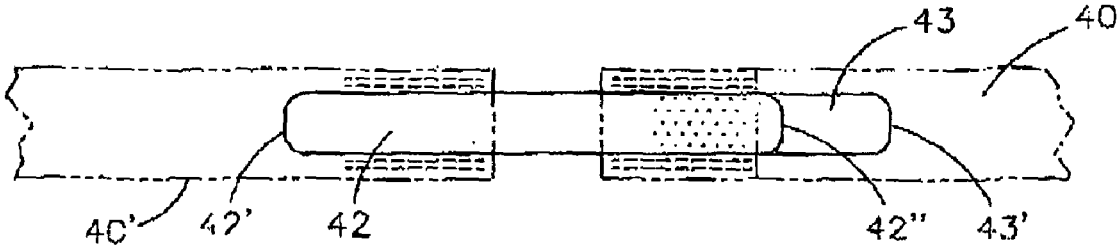
FIG. 2 shows a side elevational view of two bands cooperatively positioned in abutting relationship with respective sleeves (shown with interrupted lines) for restraining their separation and lateral movement. (The stitches are shown).
Figure 3:
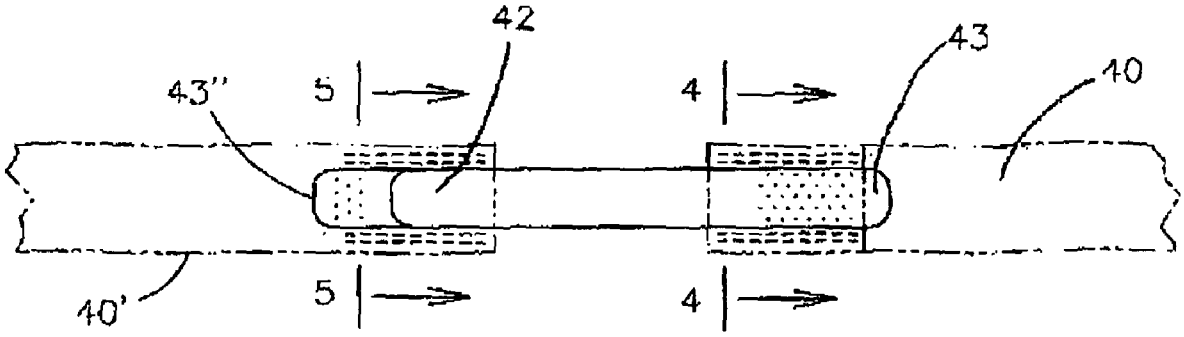
FIG. 3 illustrates the two bands shown in the previous figure wherein the relative position of the abutting bands has been changed.
Figure 4:
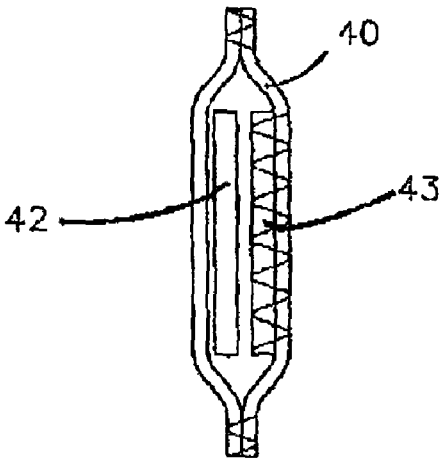
FIG. 4 is a cross-sectional view of the device shown in the previous figure taken along line 4-4, showing the band in the front in FIGS. 2 and 3 on the right with stitches holding it to the sleeve.
Figure 5:
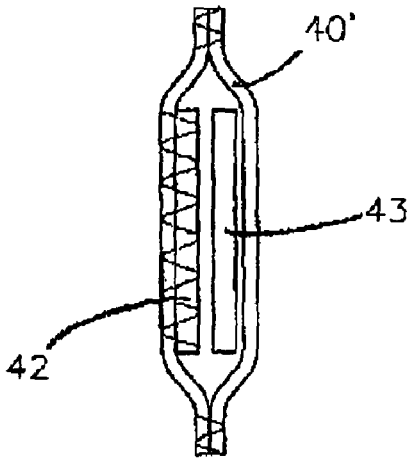
FIG. 5 is a cross-sectional view of the device shown in FIG. 3 taken along line 5-5, showing the rear band with stitches.

A user brings bands 42 and 43 inside sleeves 40 and 40' and pushes free end 42'; 43' sufficiently inside the latter to constrain the headpiece diameter. The other end 42" is affixed to sleeve 40, as seen in FIGS. 2; 3; 4; and 5. Similarly, end 43" is affixed to sleeve 40'. When a user places the headpiece on his/her head and forces the headpiece down, this causes bands 42 and 43 to slidably separate in discrete steps. The size of these steps will depend on the pattern of groups 12 and 13 used in bands 42 and 43.

For example, in FIG. 1, the pattern includes groups 12 and 13 of four magnetic section elements 6 that have the same polar orientation. These groups 12 and 13 in band or sheet 3 coincide with other groups 12' and 13' on the other sheet or band 2 where all section elements 6 of a group 12; 13 have the same orientation or opposite orientation of its poles. Then, as the bands are slid, the discrete jumps from a position where these group pairs 12; 13' or 12'; 13 have opposite poles (attract each other) to the next position where similar group pairs 12; 13' or 12'; 13 will again have opposite poles (and attract each other), it will require overcoming the repulsion force of the group pairs 12; 12' or 13; 13' that is positioned in between.

Groups 12 and 13 may include less section elements 6, such as two or even one. Understandably, the step jumps will be smaller than those experienced with the group of four section elements, as in FIG. 1. The precision of the adjustment that can be achieved will be greater with the pattern with the smaller number of elements 6 in groups 12 and 13.

Figure 6:
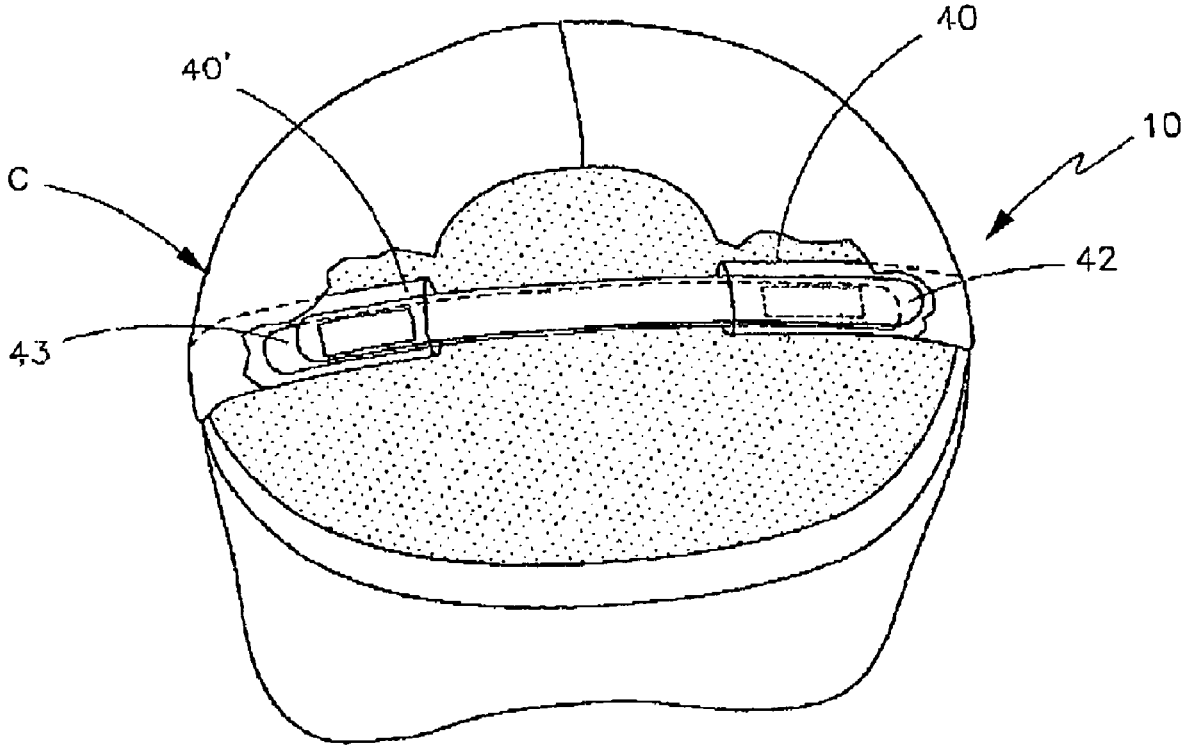
FIG. 6 shows an example of an application for the invention, being used in a cap.

In FIG. 6, an application for the present invention is illustrated. Device 10 is incorporated in the back of a cap C. Bands 42 and 43 are inverted from those shown in FIGS. 2 through 5, since their relative positions are not important. The bands can also be interrupted, provided they stay in pairs of bands 42 and 43 that are coplanarly and complementarily disposed to achieve the same effect as above.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A magnetic device with discrete slidable adjustments, comprising:

A) first and second sheets, each having a plurality of magnetic section elements with first and second poles, said section elements being disposed in first and second groups that alternate along a predetermined longitudinal path, said first group including at least one magnetic section element with its magnetic field disposed perpendicularly to said first and second sheets in one direction, and said second group including at least one magnetic section element with its magnetic field disposed perpendicularly to said first and second sheets in the opposite direction, said first and second group being contiguously disposed and alternating to create a predetermined pattern on said first and second sheets;

B) first and second means for constraining the movement of said first and second sheets to keep them in an abutting relationship with respect to each other over a predetermined length of said longitudinal path of said first and second sheets, thereby permitting said sheets to be slidably movable along said longitudinal path relative to each other in discrete steps that overcome the attraction and repulsion forces of said magnetic section elements upon the application of a force of a predetermined magnitude.

2. The device set forth in claim 1 wherein said first and second sheets have an elongated shape having each first and second ends.

3. The device set forth in claim 2 wherein said first and second constraining means includes first and second sheath members with cooperative dimensions to respectively mount said first ends interiorly in said respective first and second sheath members and said second ends being slidable within the respective sheaths opposite to those where the first ends are mounted.

4. The device set forth in claim 3 wherein said first and second sheath members are cooperatively mounted to a garment for selectively adjusting the relative position of said second ends within said sheath members.

5. The device set forth in claim 4 wherein said garment is a headwear piece with an opening on the back side, said first and second sheath members being mounted to said piece and separated by said opening so that a user can readily adjust the separation between said first and second sheath members by exerting a force on said first and second elongated bands.

6. The device set forth in claim 1 where said first and second groups have the same number of magnetic section elements.

7. The device set forth in claim 6 wherein said first and second sheets have an elongated shape having each first and second ends.

8. The device set forth in claim 7 wherein said first and second constraining means includes first and second sheath members with cooperative dimensions to respectively mount said first ends interiorly in said respective first and second sheath members and said second ends being slidable within the respective sheaths opposite to those where the first ends are mounted.

9. The device set forth in claim 8 wherein said first and second sheath members are cooperatively mounted to a garment for selectively adjusting the relative position of said second ends within said sheath members.

10. The device set forth in claim 9 wherein said garment is a headwear piece with an opening, said first and second sheath members being mounted to said piece and separated by said opening so that a user can readily adjust the separation between said first and second sheath members by exerting a force on said first and second elongated bands.

11. A magnetic device with discrete slidable adjustments, comprising:

A) one or more pairs of coplanarly disposed complementing bands, each band having a plurality of magnetic section elements with first and second poles, said section elements being disposed in first and second groups that alternate along a predetermined longitudinal path, said first group including at least one magnetic section element with its magnetic field disposed perpendicularly to said sheets in one direction, and said second group including at least one magnetic section element with its magnetic field disposed perpendicularly to said sheets in the opposite direction, said first and second group being contiguously disposed and alternating to create a predetermined pattern on said sheets B) first and second means for constraining the movement of said first and second sheets to keep them in an abutting relationship with respect to each other over a predetermined length of said longitudinal path of said bands, thereby permitting said sheets to be slidably movable along said longitudinal path relative to each other in discrete steps that overcome the attraction and repulsion forces of said magnetic section elements upon the application of a force of a predetermined magnitude.

* * * * *